US005213703A

United States Patent [19]

Furuyama et al.

[11] Patent Number: 5,213,703

[45] Date of Patent: May 25, 1993

[54] ANISOTROPIC NEODYMIUM-IRON-BORON SYSTEM PLASTIC BONDED MAGNET

[75] Inventors: Shizuo Furuyama, Katano; Kiyoshi Kojima, Ikoma, both of Japan

[73] Assignee: Matsushita Electric Industrial Co., Ltd., Osaka, Japan

[21] Appl. No.: 890,294

[22] Filed: May 27, 1992

Related U.S. Application Data

[63] Continuation of Ser. No. 649,855, Feb. 1, 1991, abandoned.

[30] Foreign Application Priority Data

Feb. 9, 1990 [JP] Japan ..... 2-30844
Aug. 14, 1990 [JP] Japan ..... 2-215366

[51] Int. Cl.[5] ..... H01F 1/30
[52] U.S. Cl. ..... 252/62.54; 148/302
[58] Field of Search ..... 252/62.54; 148/302

[56] References Cited

U.S. PATENT DOCUMENTS 4,558,077 12/1985 Gray ..... 252/62.54
4,842,656 6/1989 Maines ..... 252/62.54
4,921,553 5/1990 Tokunga ..... 252/62.54
4,975,213 12/1990 Sakai ..... 252/62.53
4,981,635 1/1991 Yamashita ..... 252/62.54

OTHER PUBLICATIONS

Perry, *Chemical Engineer's Handbook*, 5th ed, pp. 21–40 thru 21–41.

*Primary Examiner*—Jack Cooper
*Attorney, Agent, or Firm*—Ratner & Prestia

[57] ABSTRACT

This invention relates to an anisotropic neodymium-iron-boron system plastic bonded magnet containing from 10 to 20% by weight an anisotropic neodymium-iron boron system magnetic powder having a grain-size distribution from 10 to 49 microns and a resin binder. By employing this constitution, a substantially improved $(BH)_{max}$ of the compressed mold body, due to improved magnetic field orientation, is realized.

3 Claims, 2 Drawing Sheets

ANISOTROPIC NEODYMIUM-IRON-BORON SYSTEM PLASTIC BONDED MAGNET

This application is a continuation of application Ser. No. 07/649,855 filed Feb. 1, 1991, now abandoned.

FIELD OF THE INVENTION

This invention relates to an anisotropic neodymium-iron-boron system plastic bonded magnet available to construct magnetic devices including stepping motors, spindle motors, torque motors, automotive motors, various actuators, speakers, and other magnetic-field generating devices.

BACKGROUND OF THE INVENTION

Extensive efforts are being carried out to develop a new resin-bonded rare-earth magnet having a higher maximum energy product (hereinafter this is abbreviated as $(BH)_{max}$).

In order to develop a higher $(BH)_{max}$ plastic bonded magnet, employments of (1) higher magnetization $4\pi I$ and higher coercive force $iH_c$, (2) higher mold density, and (3) higher magnetic alignment of magnetic powder are considered essential. While various technical methods to attain (1) and (2) have been proposed (including those methods disclosed by Japanese Laid-Open Patents Publication No. 60-207302 and No. 60-220907), virtually no concrete means to improve the magnetic alignment of magnetic powder has been proposed, and furthermore, little knowledge has been available for kneading and dispersion of plastic bonded magnets.

SUMMARY OF THE INVENTION

The present invention offers a new neodymium-iron-boron system plastic bonded magnet having a substantially higher $(BH)_{max}$ improved by attaining a higher magnetic alignment of magnetic powder. This plastic bonded magnet contains by weight from 10 to 20% neodymium-iron boron system magnetic powder having a grain-size distribution from 10 to 49 micrometers and a resin binder.

This magnetic powder having such a grain-distribution can be obtained by kneading and dispersing the magnetic powder together with a binder. This is done by means of a high-speed shearing machine.

By employing the above-described magnetic powder constitution, a higher $(BH)_{max}$ becomes available due to a substantially improved magnetic powder's alignment of the compression molded body of the plastic bonded magnet. Furthermore, an extended pot life of the molding compound and a higher $(BH)_{max}$ value become available by employing an epoxy resin and its latent hardening agent. This hardening agent is an amine adduct of the epoxy resin.

DETAILED DESCRIPTION OF THE INVENTION

Figure 1:
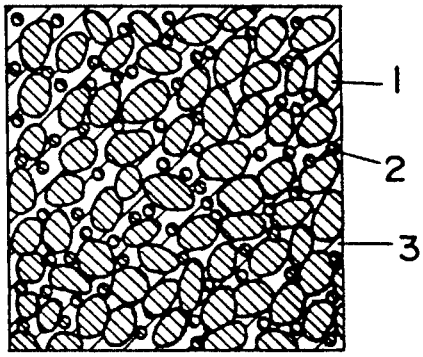
FIG. 1 shows an enlarged cross-section of an embodiment of the anisotropic neodymium-iron-boron system plastic bonded magnet.

One example of the present invention is explained by reference to FIG. 1. In this figure, 1 is an anisotropic neodymium-iron-boron system magnetic powder having a grain size distribution from 50 to 500 micrometers, 2 is an anisotropic neodymium-iron-boron system magnetic powder having grain sizes from 10 to 49 micrometers, and 3 is a plastic resin binder. The anisotropic neodymium-iron-boron system magnetic powder employed in this invention can be an anisotropic neodymium-iron-boron system magnetic powder manufactured by upsetting its overquenched melt spun ribbon.

Figure 2:
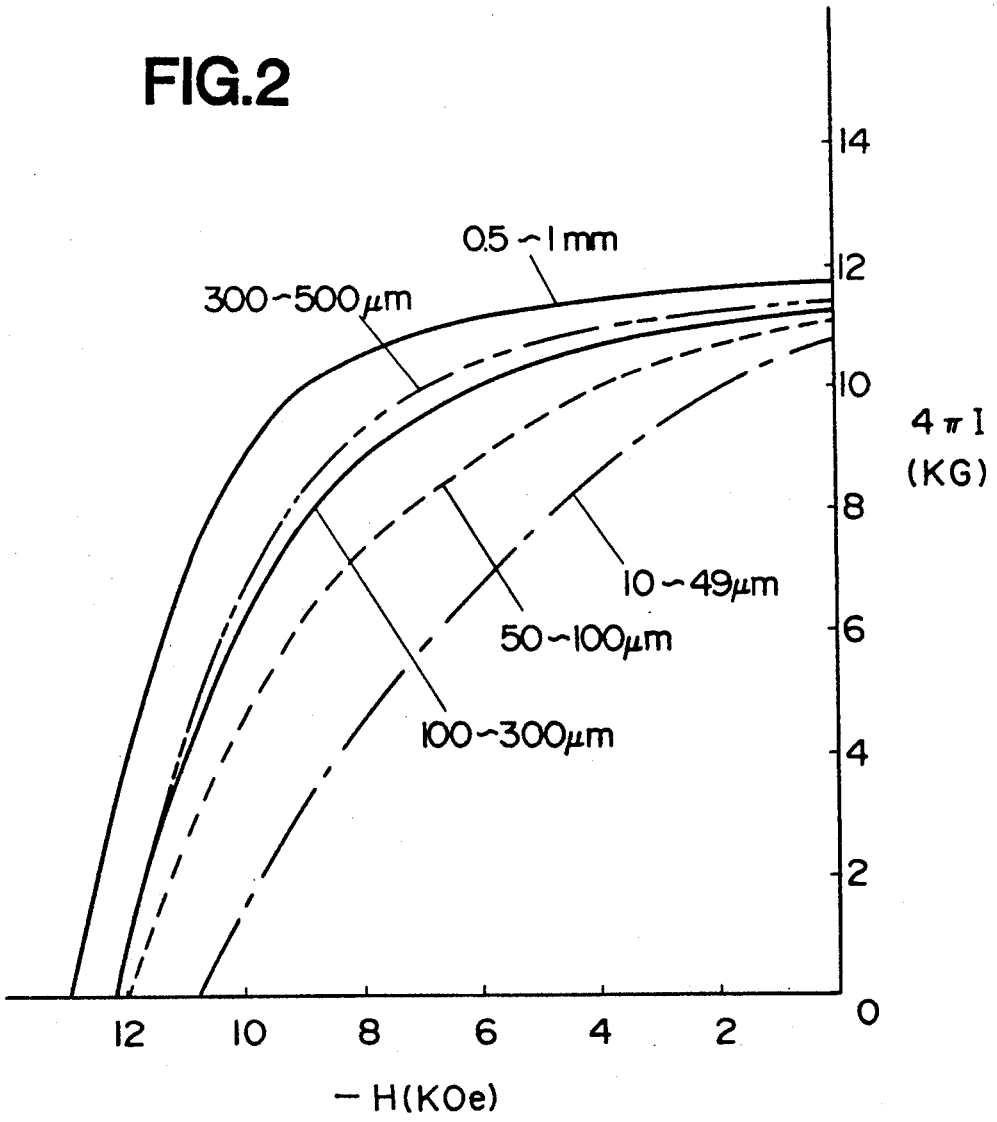
FIG. 2 shows the relationship between the grain-size of magnetic powder of the invention and the magnetic characteristics.

Furthermore, additions of elements such as zirconium, gallium, cobalt, praseodymium and tin are possible for improving the magnet's temperature characteristics, anti-corrosion properties and magnetic properties. The magnetic powder employed in the invention is characterized by its excellent magnetic properties (magnetization $4\pi I$, coercive force $iH_c$), which are substantially governed by the grain size distribution of the magnetic powder as shown in FIG. 2.

The magnetic characteristics of magnetic powder having grain sizes less than 49 micrometers are significantly different than the magnetic characteristics of powder having grain sizes greater than 49 micrometers.

This invention is not intended to exclude magnetic powder having grain sizes less than 49 micrometers which could be attributed to its inferior magnetic properties, but is intended to introduce a limited amount of such magnetic powder into a molding compound for improving the magnetic powder's alignment of molding compound. The magnetic powder's alignment of the plastic bonded magnet is highly improved by introducing a magnetic powder having fine grain sizes from 10 to 49 micrometers in an amount of 10 to 20% by weight. The reasons for this cannot be attributed to the higher density of the compression molded body but can be attributed to the improved flowability of the plastic bonded magnet compound.

In the above case, it is desirable to exclude magnetic powder having grain sizes less than 10 micrometers because of the poor magnetic characteristics of such powder (as opposed to utilization of the magnetic powder's alignment effects). The content of fine magnetic powder may be limited to less than 20% by weight, but the alignment effect cannot be attained if the powder's content is less than 10% by weight. Although large sized magnetic powder having grain sizes more than 500 micrometers is excellent in its magnetic characteristics, a reduction of mold density occurs. Thus, no improvement in residual magnetic flux density $B_r$ can be expected.

Though fatty acids, silane-coupling agents, and various surface-active agent can each be employed as a dispersing agent, a liquid formed fatty acid, or oleic acid, is found particularly suitable for this purpose. This ability to function as a dispersing agent is attributed to the liquid's higher affinity to magnetic powder. Furthermore, this ability cannot be attained by any of the solid fatty acids. Thus, this ability is particularly advantageous (from the stand point of productivity) to a compressive molding which is performed conventionally at room temperature.

Although it is important to limit the amount of fatty acid additives, it is preferable that the fatty acids constitute more than 0.8% by weight of the magnetic powder. An amount of fatty acids, less than 0.7% by weight, results in an inadequate affinity to the magnetic powder, density, and $(BH)_{max}$. On the other hand, if an excessive amount of fatty acids, more than 1.3% by weight, is added, oozing of binder and lower molding strength result. These properties are undesirable as a matter of course.

As for the binder employed for the room temperature molding of the magnetic material of this invention, an employment of liquid-formed epoxy resin is desirable from a stand point of adhesion strength.

The total amount of the binder component is determined from aspects of attainable magnetic characteristics and mold strength. If a binder amount of less than 1.4% by weight is introduced to the magnetic powder, inadequate mold strength results. If the binder amount is more than 3.0% by weight, poor magnetic characteristics result.

As for the hardening agent, one of various amines or acid anhydrides can be used. If an amine adduct of epoxy resin is used as a hardening agent for the epoxy resin which is used as a binder, a substantially extended pot life for molding the compound (compared to a conventional amine system hardening agent) can be realized.

As for the dispersion equipment, a high-speed shearing machine capable of pulverizing and mixing magnetic powder, such as a Henschell mixer, upper-mill, high-speed mixer, or a micro-mill grinder can be employed.

Typical embodiments of the present invention are now explained.

Embodiment 1

A mixture consisting of 100 weight part of anisotropic Nd-Fe-B magnetic powder having grain sizes from 1 to 2 mm and a 0.9 weight part of oleic acid as a dispersion agent are mixed and dispersed in a micro-mill grinder for about five minutes, and a 1.0 weight part of epoxy resin, or Epikote 828 (manufactured by Yuka-Shell Epoxy Co.) is added thereto, and mixed and dispersed for another ten minutes.

This mixing and dispersion process is completed by adding a 0.9 weight part of acid anhydride, or Kayahard MCD (manufactured by Nihon Kayaku Co.) and a 0.01 weight part of catalytic imidazole, or Epikure EMI-24 (manufactured by Shikoku Kasei Kogyo Co.) thereto, and mixed and dispersed for another ten minutes.

The prepared plastic bonded magnet compound is then injected into a metal mold, and is molded at room temperature applying a compression force of 6 ton/cm$^2$ under the application of a magnetic field of 15 KOe. After a hardening process conducted at 100° C. for one hour, the plastic bonded magnet of the invention is produced.

For the purposes of analysis, the mold before hardening is immersed in acetone to remove resin components. The obtained magnetic powder is then dried in a nitrogen atmosphere. The grain size distribution of this magnetic powder is measured and found to be:

| Grain sizes | Composition |
|---|---|
| 500–800 μm | 5% by weight |
| 50–500 μm | 80% by weight |
| 10–49 μm | 14% by weight |
| less than 10 μm | 1% by weight |

Comparison 1

A mold for comparison purposes is prepared by using a process identical with the one used for Embodiment 1 (except that magnetic powder as raw material having grain sizes from 300 to 500 μm is used). The grain size distribution is found to be:

| Grain sizes | Composition |
|---|---|
| 50–100 μm | 60% by weight |
| 10–49 μm | 30% by weight |
| less than 10 μm | 5% by weight |

Comparison 2

When a process identical with the one for Embodiment 1 is used to prepare another mold (except that magnetic powder as raw material having grain sizes from 3 to 4 mm is used), the grain size distribution is found to be:

| Grain sizes | Composition |
|---|---|
| 1–2 mm | 5% by weight |
| 0.5–1 mm | 16% by weight |
| 50–500 μm | 68% by weight |
| 10–49 μm | 10% by weight |
| less than 10 μm | 1% by weight |

Comparison 3

When a process identical with the one for Embodiment 1 is employed to prepare another comparison purpose magnet (except that its mixture is mixed and dispersed for 12 hours in a ball-mill using acetone as a solvent), the grain size distribution is found to be:

| Grain sizes | Composition |
|---|---|
| 50–500 μm | 10% by weight |
| 10–49 μm | 78% by weight |
| less than 10 μm | 12% by weight |

Embodiment 2

In this case, an electromagnetic steel plate made of soft magnetic material is inserted in a die before the anisotropic magnet compound is molded. The molding of the compound is conducted at room temperature under applications of both a compression force of 6 ton/cm$^2$ and a magnetic field of 15 KOe. After a hardening process at 100° C. for two hours, a plastic bonded magnet integrated with the electromagnetic steel plate made of soft magnetic material is prepared. The adhesion between the electromagnetic steel plate and the plastic bonded magnet is found to be adequately high.

The determined densities, magnetic characteristics and magnetic powder's alignment of the plastic bonded magnets obtained by Embodiments 1 and 2, and Comparisons 1, 2, and 3 are tabulated in Table 1.

The degree of magnetic alignment of magnetic powder is defined as $B_r(//)/[B_r(//)+B_r(\perp)]$. This represents the ease of movement of magnetic powder under an application of an external magnetic field. A higher value indicates a higher magnetic powder's alignment. ($B_r(//)$ and $B_r(\perp)$ represent a residual magnetic flux density along the applied magnetic field and a residual magnetic flux density vertical to the applied magnetic field respectively.

TABLE 1

| Sample | Characteristics | | |
|---|---|---|---|
| | Density (g/cc) | Degree of magnetic orientation | $(BH)_{max}$ MGOe |
| Embodiment 1 | 6.20 | 0.70 | 15 |
| Comparison 1 | 6.19 | 0.69 | 13 |
| Comparison 2 | 6.15 | 0.68 | 12 |
| Comparison 3 | 6.18 | 0.66 | 11 |

Table 1 shows that plastic bonded magnets having higher densities, degrees of magnetic alignment of magnetic powder and $(BH)_{max}$ values can be obtained by the present invention.

Figure 3:
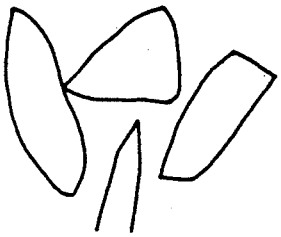
FIG. 3 shows a schematic configuration of magnetic powder employed to realize Embodiment 1.
Figure 4:
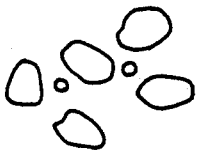
FIG. 4 is a schematic diagram showing a grain configuration of magnetic powder after kneading and dispersion of the magnetic powder shown in FIG. 1.
Figure 5:
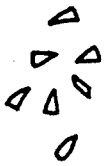
FIG. 5 shows a schematic diagram of the grain configuration of magnetic powder after kneading and dispersion of magnetic powder used to realize Embodiment 3.

Changes in grain configurations of magnetic powder are shown in FIG. 3, 4, and 5. FIG. 3 shows a schematic configuration of raw magnetic powder material. FIG. 4 is a schematic showing the rounded off grains of magnetic powder after pulverization and mixing conducted by a high-speed shearing machine which is employed to prepare the magnet of Embodiment 1. FIG. 5 is a schematic diagram showing grain configuration of magnetic powder after kneading and dispersion of magnetic powder of Comparison 3 showing more squarish and smaller grain sizes in comparison with those shown in FIG. 4.

As shown in Embodiment 1, higher magnetic alignment of magnetic powder, higher density, and higher $(BH)_{max}$ can be realized by the grain size changes produced by the pulverization and dispersion process conducted by a high-speed shearing machine.

The reasons for these improvements are explained as follows.

Whereas the magnet of Embodiment 1 contains 14% by weight magnetic powder having grain sizes from 10 to 49 μm, the concentrations of the magnet powder are 30% by weight, 10% by weight, and 75% by weight in Comparisons 1, 2 and 3 respectively. Those improvements of magnetic alignment of magnetic powder in Embodiment 1 and Comparison 2 are due to the containment of 10 to 20% by weight magnetic powder having grain sizes from 10 to 49 μm. While the magnetic alignment of magnetic powder are 0.70 and 0.68 in the cases of Embodiment 1 and Comparison 2 respectively, it is 0.65 in Comparison 3.

This improvement of magnetic alignment of magnetic powder is attributed to the improved flowability of compressive molding compound to which fine magnetic powder having grain sizes from 10 to 49 μm is introduced in concentrations of 10 to 20% by weight. This type of magnetic powder had been attributed to the lower magnetic characteristics of resultant plastic bonded magnet in the past.

Furthermore, as shown in Embodiment 1, the improvement of $(BH)_{max}$ is attributed to the higher magnetic alignment of magnetic powder and improved density due to the employed magnetic powder which is rounded off during the high-speed shearing process. The density of the magnet of Comparison 2 is 6.15. This density is low because the magnet contains magnetic powder having grains sizes from 1 to 2 mm. Thus, the $(BH)_{max}$ is also low.

This means that the improvements of both alignment and density are essential to improve $(BH)_{max}$. Thus, a plastic bonded magnet containing 10 to 20% by weight magnetic powder and having a grain size distribution covering from 10 to 49 μm which are kneaded and dispersed therein by using a high-speed shearing machine is developed.

According to a developed plastic bonded magnet mold integrated with a electromagnetic steel plate of soft magnetic material shown in Embodiment 2, the adhesion strength between these parts are satisfactory without using any adhesives. Thus, a simplification of the manufacturing process is realized.

Embodiment 3

An anisotropic Nd-Fe-B system magnetic powder having an average grain size of 1 mm and oleic acid are mixed at a weight ratio of 100 to 0.9. This mixture is mixed and dispersed for 10 minutes by a high-speed mixer under a nitrogen atmosphere.

Then, an epoxy resin, or Epikote-828, manufactured by Yuka-Shell Epoxy Co., is added thereto by 1.6 weight parts. This is mixed and dispersed for another ten minutes. To this mixture, a latent hardening agent, or Amicure PN-23, manufactured by Ajinomoto Co., is added by 0.4 weight part. This mixture is then mixed and dispersed for another 10 minutes.

The anisotropic plastic bonded magnet compound, thus produced, is loaded into a die cavity and a compressive pressure of 6 ton/cm$^2$ is applied under an application of magnetic field of 15 KOe. Then, the anisotropic plastic bonded magnet of is produced after an application of the hardening process for one hour at 100° C.

Comparison 4

A plastic bonded magnet in this case is prepared by the same magnetic material and process employed for preparing Embodiment 3. However, the binder system is altered as follows:

| | |
|---|---|
| Anisotropic Nd—Fe—B magnetic powder | 100 weight parts. |
| Oleic acid | 0.9 weight part. |
| Epoxy resin (Epikote-828): | 1.5 weight part. |
| Aliphatic amine (LX-1N, Yuka-Shell Epoxy Co.) | 0.5 weight part. |

Comparison 5

A plastic bonded magnet in this case is prepared by the same magnetic material and process employed for preparing Embodiment 3. However, the binder system is altered as follows:

| | |
|---|---|
| Anisotropic Nd—Fe—B magnetic powder | 100 weight parts |
| Oleic acid | 0.9 weight part. |
| Epoxy resin (Epikote-828) | 1.25 weight part. |
| Aromatic Amine (Acmex H-90, Nihon Gouseikako Co.) | 0.75 weight part. |

The initial magnetic characteristics, $(BH)_{max}$, and the pot life of the above obtained plastic bonded magnet compound are tabulated in Table 2. The pot life of the above obtained anisotropic plastic bonded magnet compound is determined by the evaluation process described. As the compound thus obtained is left still at room temperature, a sample plastic bonded magnet is molded every one hour under the previously described molding conditions. The pot life is defined by the hour at which the sample molded magnet exhibits magnetic characteristics which are 5% lower than the initial magnetic characteristics of the magnet.

TABLE 2

| Sample | Characteristics: Initial mag. Characteristics, $(BH)_{max}$ | Characteristics: Pot life (hour) |
|---|---|---|
| Embodiment 3 | 15 MGOe | 20 |
| Comparison 4 | 12 | 3 |
| Comparison 5 | 15 | 6 |

The plastic bonded magnet shown in Embodiment 3 (wherein a latent hardening agent is used) shows a value of $(BH)_{max}$ as high as 15 MGOe and a pot life as long as 20 hours which are practically useful. A mold compound having a long pot life; and is used to minimize the possibility of stability damage of binder system due to the local heat produced at mixing and dispersing by a high-speed shearing machine.

On the other hand, with the plastic bonded magnet produced by using the aliphatic amine hardening agent shown in Comparison 4, a value of $(BH)_{max}$ of 12 MGOe and a pot life of only 3 hours are obtained. This has very little practical applicability. However, with the magnet produced by using aromatic amine hardening agent shown in Comparison 5, a value of $(BH)_{max}$ of 15 MGOe which is adequately high is obtained. However, a pot life of 6 hours is obtained. This is still considered inadequate in practical application.

As mentioned above, the $(BH)_{max}$ of the mold and pot life are governed largely by the type of employed hardening agent. The difference between magnet characteristics of the molds can be attributed to the difference between the affinities of binders to the magnetic powder which results in the difference between dispersibilities.

The difference between pot lives can be attributed to the difference between thermal stabilities of the employed binder systems against local heat generation. The latent hardening agent employed in the embodiments of the invention means a hardening agent which does not start hardening until a certain temperature after it is mixed with a primary epoxy resin. Since this hardening system has a high thermal stability, this is considered highly useful to extend the pot life.

As above disclosed, an anisotropic neodymium-iron-boron system plastic bonded magnet to which the magnetic powder having grain sizes from 10 to 49 μm is introduced of 10 to 20% by weight shows excellent magnetic characteristics. Furthermore, the present invention offers an anisotropic neodymium-iron-boron system plastic bonded magnet whose mold compound has a prolonged pot life. This is substantially improved by employing both an epoxy resin binder and a latent hardening agent (which is an amine adduct of epoxy resin).

While the invention has been described in terms of an exemplary embodiment, it is contemplated that it may be practiced as outlined above with modifications within the spirit and scope of the appended claims.

What is claimed:

1. An anisotropic NEODYMIUM-IRON-BORON system plastic bonded magnet consisting essentially of:
   - a resin binder, in amount greater than 1.4% by weight and less than 3.0% by weight and
   - an anisotropic NEODYMIUM-IRON-BORON system magnetic powder consisting essentially of
     - 10 to 20% by weight of particles having a rounded shape and having a size of 10 to 49 micrometers and
     - 80 to 90% by weight of particles having a rounded shape and having a particle size of 50 to 500 micrometers.

2. The anisotropic NEODYMIUM-IRON-BORON system plastic bonded magnet according to claim 1, wherein during the preparation thereof said powder is pulverized, and dispersed with said resin binder in a high-speed shearing machine.

3. The anisotropic neodymium-iron-boron system plastic bonded magnet according to claim 1, wherein the resin binder is an epoxy resin including an amine aduct of the epoxy resin as a latent hardening agent for said epoxy resin.

* * * * *